US007786373B2

(12) United States Patent
Adams

(10) Patent No.: US 7,786,373 B2
(45) Date of Patent: Aug. 31, 2010

(54) DEVICE AND METHOD FOR AUTOMATICALLY TUNING A STRINGED INSTRUMENT, PARTICULARLY A GUITAR

(75) Inventor: Christopher Adams, Hamburg (DE)

(73) Assignee: Tectus Anstalt, Vaduz (LI)

( * ) Notice: Subject to any disclaimer, the term of this patent is extended or adjusted under 35 U.S.C. 154(b) by 348 days.

(21) Appl. No.: 11/568,537

(22) PCT Filed: Jan. 19, 2005

(86) PCT No.: PCT/EP2005/000478

§ 371 (c)(1),
(2), (4) Date: Jul. 17, 2008

(87) PCT Pub. No.: WO2005/116986

PCT Pub. Date: Dec. 8, 2005

(65) Prior Publication Data

US 2008/0282869 A1 Nov. 20, 2008

(30) Foreign Application Priority Data

May 13, 2004 (EP) ..... 04011357

(51) Int. Cl.
*G10H 3/14* (2006.01)
*G10G 7/02* (2006.01)

(52) U.S. Cl. ..... 84/728; 84/455

(58) Field of Classification Search ..... 84/455, 84/728, 7, 9, 173, 267, 312 R, 602, 604, 654
See application file for complete search history.

(56) References Cited

U.S. PATENT DOCUMENTS 3,130,626 A 4/1964 Martin (Continued)

FOREIGN PATENT DOCUMENTS

AT 006 906 U1 5/2004

(Continued)

*Primary Examiner*—Jeffrey Donels
(74) *Attorney, Agent, or Firm*—Hunton & Williams LLP

(57) ABSTRACT

A device for automatically tuning a stringed instrument, particularly a guitar, comprising: a detecting device for detecting a note produced by strumming a string and for outputting a digital signal corresponding to the detected note; a memory device for storing default digital signals corresponding to a desired note; a comparator for comparing the digital signal output by the detecting device with a digital signal, which is stored in the memory device and which corresponds to the desired note; an adjusting device for altering the tension of the strings; at least one drive for driving the adjusting device, and; a controller, which is connected to the comparator and which controls the at least one drive via a bus line based on a difference between the signals representing the produced note and the desired note, this difference being determined in the comparator. The inventive device is improved compared to that of the prior art by virtue of the fact that it can be integrated in an instrument, particularly a guitar, while having a minimal influence upon the sound characteristics and with as few as possible elements that are also small. To this end, the controller and the at least one drive are placed inside the stringed instrument while being situated, when viewing in a longitudinal of the strings, on opposite sides of the strings, and the bus line is led between the controller and the at least one drive while spanning the length of the strings. The invention also relates to a method for automatically tuning a stringed instrument.

15 Claims, 9 Drawing Sheets

U.S. PATENT DOCUMENTS

| | | | | | |
|---|---|---|---|---|---|
| 3,813,983 | A | | 6/1974 | Paul | |
| 4,018,124 | A | | 4/1977 | Rosado | |
| 4,088,052 | A | | 5/1978 | Hedrick | |
| 4,128,033 | A | | 12/1978 | Petillo | |
| 4,197,779 | A | | 4/1980 | Holman | |
| 4,318,327 | A | | 3/1982 | Toups | |
| 4,426,907 | A | | 1/1984 | Scholz | |
| 4,681,010 | A | | 7/1987 | Wilkinson | |
| 4,791,849 | A | | 12/1988 | Kelley | |
| 4,803,908 | A | | 2/1989 | Skinn et al. | |
| 4,909,126 | A | | 3/1990 | Skinn et al. | |
| 5,009,142 | A | * | 4/1991 | Kurtz | 84/454 |
| 5,065,660 | A | | 11/1991 | De Buda | |
| 5,265,513 | A | | 11/1993 | Smith | |
| 5,323,680 | A | * | 6/1994 | Miller et al. | 84/455 |
| 5,337,644 | A | | 8/1994 | Fishman et al. | |
| 5,343,793 | A | | 9/1994 | Pattie | |
| 5,390,579 | A | | 2/1995 | Burgon | |
| 5,767,429 | A | | 6/1998 | Milano et al. | |
| 5,824,929 | A | * | 10/1998 | Freeland et al. | 84/454 |
| 5,977,467 | A | * | 11/1999 | Freeland et al. | 84/454 |
| 5,986,190 | A | | 11/1999 | Wolff et al. | |
| 6,184,450 | B1 | | 2/2001 | LeBlanc | |
| 6,184,452 | B1 | * | 2/2001 | Long et al. | 84/457 |
| 6,271,456 | B1 | | 8/2001 | Nelson | |
| 6,278,047 | B1 | * | 8/2001 | Cumberland | 84/455 |
| 6,437,226 | B2 | * | 8/2002 | Oudshoorn et al. | 84/454 |
| 2002/0104428 | A1 | | 8/2002 | Wilson | |

FOREIGN PATENT DOCUMENTS

| | | | |
|---|---|---|---|
| DE | 35 09 662 | A1 | 10/1986 |
| FR | 2 365 850 | | 4/1978 |
| GB | 2 226 910 | A | 7/1990 |
| WO | WO 97/04442 | | 2/1997 |
| WO | WO 01/67431 | A1 | 9/2001 |
| WO | WO 03/012774 | A1 | 2/2003 |
| WO | WO 2005/114647 | A1 | 12/2005 |
| WO | WO 2005/116984 | A1 | 12/2005 |
| WO | WO 2005/116985 | A1 | 12/2005 |
| WO | WO 2005/116986 | A1 | 12/2005 |
| WO | WO 2006/076928 | A2 | 7/2006 |

* cited by examiner

DEVICE AND METHOD FOR AUTOMATICALLY TUNING A STRINGED INSTRUMENT, PARTICULARLY A GUITAR

The present invention relates to a device for automatic tuning of a string instrument with a detection device for detecting a tone generated when a strings struck as well as for the output of a digital signal corresponding to the detected tone, a memory device for storing preset digital signals, which correspond to a desired tone, a comparison device for comparing the digital signal output by the detection device with a digital signal stored in the memory device and corresponding to the desired tone, an adjustment device for changing the tension of the strings, at least one drive for driving the adjustment device, and a controller, which is connected to the comparison device and which controls the one or more drives with reference to a deviation determined in the comparison device between signals representing the generated tone and the desired tone. It further relates to a method for automatic tuning of a string instrument in which a string to be tuned is struck, the tone generated by the string is detected by a detection device and converted into a corresponding first digital signal and the first digital signal is compared with a preset, second digital signal corresponding to a desired tone and a necessary change in the string tension is calculated in a controller from the comparison.

In general, tuning instruments requires, in addition to a trained ear, a large amount of time, especially for untrained, for example, amateur instrumentalists. In the classic method of tuning "by hand," the musician works with a tuning fork, which gives a desired tone when it is struck, and the pitch of the relevant string is adjusted by changing the string length or string tension. By striking the string and the tuning fork several times, the result is equalized until the desired tuning of the string is achieved. Starting from this tuning, the other strings are then tuned.

On the one hand, because the strings of the instrument always have to be tuned regularly due to an ever present elasticity of the material and, on the other hand, because the strings are also variable in length as a function of the climatic conditions (on the stage of a concert hall, a guitar string will expand with the heat and humid air in comparison with the conditions in the relatively dry and cool practice room), frequent tuning is necessary. Also, after installing new strings, these must be tuned.

To create a simplification here, in U.S. Pat. No. 4,803,908 a device for automatic tuning of a string instrument was propose. In this device, all of the strings are struck simultaneously on a guitar with an aid, which is called "strummer" in this publication and which is arranged in the body of the guitar. Electronics detects the tones, compares them with the desired setting, and controls an adjustment device engaging the strings for adjusting the string tensions, such that they match the preset tones.

The system is very welcome to the extent that it allows easy and automatic tuning and takes away a large amount of work, especially for inexperienced musicians, and also for professionals. The system has a not insignificant disadvantage, however. Overall it is large and clumsy and requires considerable changes to the body of the guitar, which affect, on the one hand, the acoustics (sound) of the guitar and, on the other hand, the handling of the guitar (due to the changed weight). Apart from these characteristics, the appearance of the guitar is also changed not insignificantly.

Because the entire guitar forms the resonance body that is responsible for the sound characteristics, the sound characteristics also change when the body is changed. Thus, the previously known system is practically impossible to retrofit in existing instruments, and it is also difficult to integrate into new guitars. In particular, in terms of the sound, two guitar types were to be developed independently from each other in the design work, one guitar with the known device and one without.

SUMMARY OF THE INVENTION

The invention starts with the mentioned problems. The task of the invention is to present a device that is improved to the extent that it can be integrated into an instrument, in particular, a guitar, with minimal effect on the sound characteristics and with elements that are as few and small as possible. Furthermore, a method for automatic tuning of a string instrument is to be presented, which satisfies these conditions.

To accomplish this task, a device is proposed characterized in that a power supply voltage of components of the device arranged on a first side of the strings in the longitudinal direction is supplied starting from a voltage source or a voltage tap arranged on the opposite, second side of the strings in the longitudinal direction of the strings via at least one of the strings, wherein at least one string is composed of an electrically conductive material or is wound or coated with such a material. A method that accomplishes this task is characterized in that a power supply voltage of components of the device arranged on a first side of the strings in the longitudinal direction is supplied starting from a voltage source or a voltage tap arranged on the opposite, second side of the strings in the longitudinal direction of the strings via at least one of the strings, wherein at least one string is composed of an electrically conductive material or is wound or coated with such a material.

The core concept of the invention is to feed the required power-supply voltage to at least parts of the components of the device via one or more of the strings. For this purpose, the strings have a conductive construction; they are composed of either a conductive material or they are wound and/or coated with such a material. In this way, for example, in a guitar, in particular an electric guitar, components can be arranged on the head of this guitar, without also having to integrate a power supply at this location (for example, in the form of a battery or a separate power-supply connection). In this example, the power-supply voltage can be fed via the body of the guitar and guided to the head via the one or more guitar string(s).

In this way, it is possible to arrange at least a few of the components of the device in a way that saves weight and space on a section of the instrument, which lies on one longitudinal end of the strings, on which there is either less space or which can support less weight.

According to one embodiment of the invention, the components of the device (which, viewed as such, can also be called a system) are distributed on the instrument and a bus line bridges the distance along the length of the strings. In a guitar, for example, the entire device is not arranged in the body. Thus, the head or the neck also offers space, even if only a little, for (unobtrusive) mounting of additional components. In particular, the device can resort to using means already arranged on the head of guitars for adjusting the string length or tension, which reduces the use of special parts. Overall, in the instrument, for example, the guitar, fewer additional components must be installed.

The signal can be transmitted via the bus line, for example, via a conventional bus cable, and also in a wireless method, for example, via radio or infrared.

To be able to separate the control and drive components without far-reaching intrusion into the instrument body, however, according to an improvement of the invention the control signals are guided between the controller sitting on one instrument part and the one or more drives via the strings acting as bus lines. In many cases, the strings of string instruments are composed of a conductive material (metal) or are wound by a thread made from such a material. Alternatively, if the sound allows, they can be coated with a conductive material. This solution spares the use of additional lines that must be laid in the instrument body. In this way, in addition to the sound characteristics, not least of all the appearance of the instrument is maintained. If several strings are to be used as wires, to ensure that these strings are not electrically short-circuited to each other, elements guiding the strings together (for example, the bridge of a guitar) must be constructed so that they insulate the strings from each other. For this purpose, these elements can be fabricated from a non-conductive material (for example, ceramic) or can be coated with such a material or other precautions for insulation must be taken (for example, intermediate insulating disks, etc.).

The drive can be a motor, for example, an electric motor, but it can also operate pneumatically or hydraulically.

If the instrument is an instrument connected electrically to an amplifier (e.g., an electric guitar), then an already present pickup, which is connected to the amplifier and which is part of the instrument, can be used as (part of) the detection unit.

Through a construction of the controller as given in one embodiment of the invention, the controller can be activated in a simple way by striking one string.

An interface, as can be provided according to one embodiment of the invention, gives the ability to feed software into the device from the outside—also at a later time. Furthermore, different reference tunings can be input into the memory device via the interface, in order to be able to tune the instrument according to different tunings.

A construction of the device as proposed in one embodiment of the invention allows string-by-string tuning of the instrument. A drive, which can be switched by means of corresponding gears or similar devices for adjusting each string, can also be used just as well.

In one embodiment of the invention, an especially compact construction is provided. If the individual components are selected to be as small as possible, they practically "disappear" into the overall appearance of the instrument and also do not interfere with the musician when he or she is playing. In addition, it is not necessary to attach external components for tuning the instrument. The musician can tune his instrument practically anywhere and nearly independently.

One improvement of the device produces a redundant system. The device can also continue to operate for tuning the instrument even if one string is defective.

In other embodiments of the invention, a preferred construction of the device is given for integration into an electric guitar.

In another embodiment the strings of the instrument can be preferably used as bus lines. In this way, separate cables or other transmission means (radio, infrared) do not have to be installed.

Processing of the first digital signal as required in an improvement of the method in one embodiment can be useful to be able to reliably determine a pitch from this signal.

The bass frequency (pitch) of the first digital signal is determined preferably with the aid of a mathematical frequency filter in a further embodiment of the invention. In contrast to the otherwise common method of Fast Fourier Transformation (FFT), this filter allows a faster and more precise frequency determination from only one strike of a string. This is important, because when a string is struck only one time, the harmonics, which must be detected for an exact determination of the pitch (frequency), die away very quickly.

Below, the invention is described briefly with reference to the attached figures. Shown are:

DETAILED DESCRIPTION OF THE INVENTION

Figure 1:
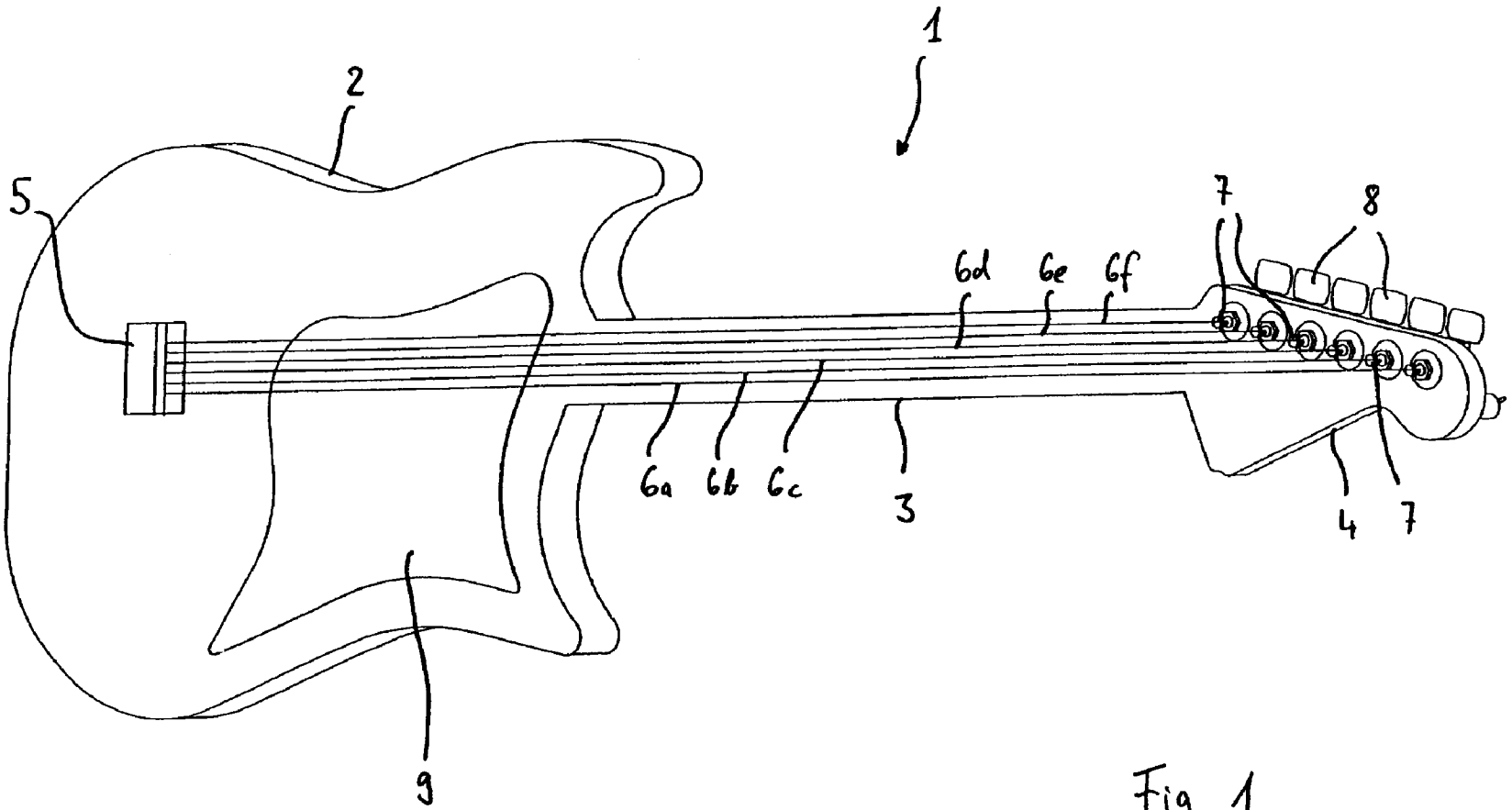
FIG. 1, a schematic view of an electric guitar from the front as a possible embodiment of the invention, FIG. 2, a schematic view of the electric guitar from FIG. 1 from behind, FIG. 3, another schematic view of the electric guitar with other details, FIG. 4, an enlarged representation of the body of the electric guitar according to the representation in FIG. 3, FIG. 5, in four different representations (a)-(d), a saddle of the tremolo system block of the electric guitar, FIG. 6, schematically the attachment of the strings in the tremolo system block, as well as their contact with the power-supply lines or signal lines, FIG. 7, in four different views (a)-(d), the head of the guitar with attached pegs and actuators for setting the string tension, FIG. 8, in four different views, the pegs sitting in the head of the guitar with the servo-motors, and FIG. 9, a schematic circuit diagram of a detector circuit for controlling tone-wire feeding for the device for automatic tuning of the guitar.

In the figures, the invention is explained with reference to an embodiment for an electric guitar. Identical elements are provided with identical reference symbols in the figures. The description with reference to an electric guitar does not limit the invention. It can be used just as well for acoustic guitars, electric bass guitars, or other electric or electric-acoustic or acoustic string instruments, such as violins, harps, etc.

In FIGS. 1-4, an electric guitar 1, which is provided with a device according to the invention, is shown in different, partially enlarged views. The electric guitar 1 can be divided roughly into the body 2, the neck 3, and the head 4. On the body, the strings 6*a*-6*f* are fixed with their first ends (ball ends) to the so-called tremolo system block 5 and are set in tension one next to the other over the neck 3 up to the head 4, where they are wound on adjuster devices 7 with their second ends and can be adjusted. The adjuster devices 7 are connected mechanically to tuning pegs 8, so that by turning the tuning pegs 8, the string end on the adjuster device 7 can be wound onto this head or unwound from this head. In this way, the tension or length of the string is changed and the guitar is tuned.

In FIG. 1, a so-called pick guard 9 can also be seen, which is a kind of covering plate and under which, in the body 2, a space is created, in which the electronics of the electric guitar 1 are arranged. Underneath this pick guard 9 there is a controller chip, which is part of the device according to the invention and which is indicated schematically with 10 in FIG. 2.

Figure 2:
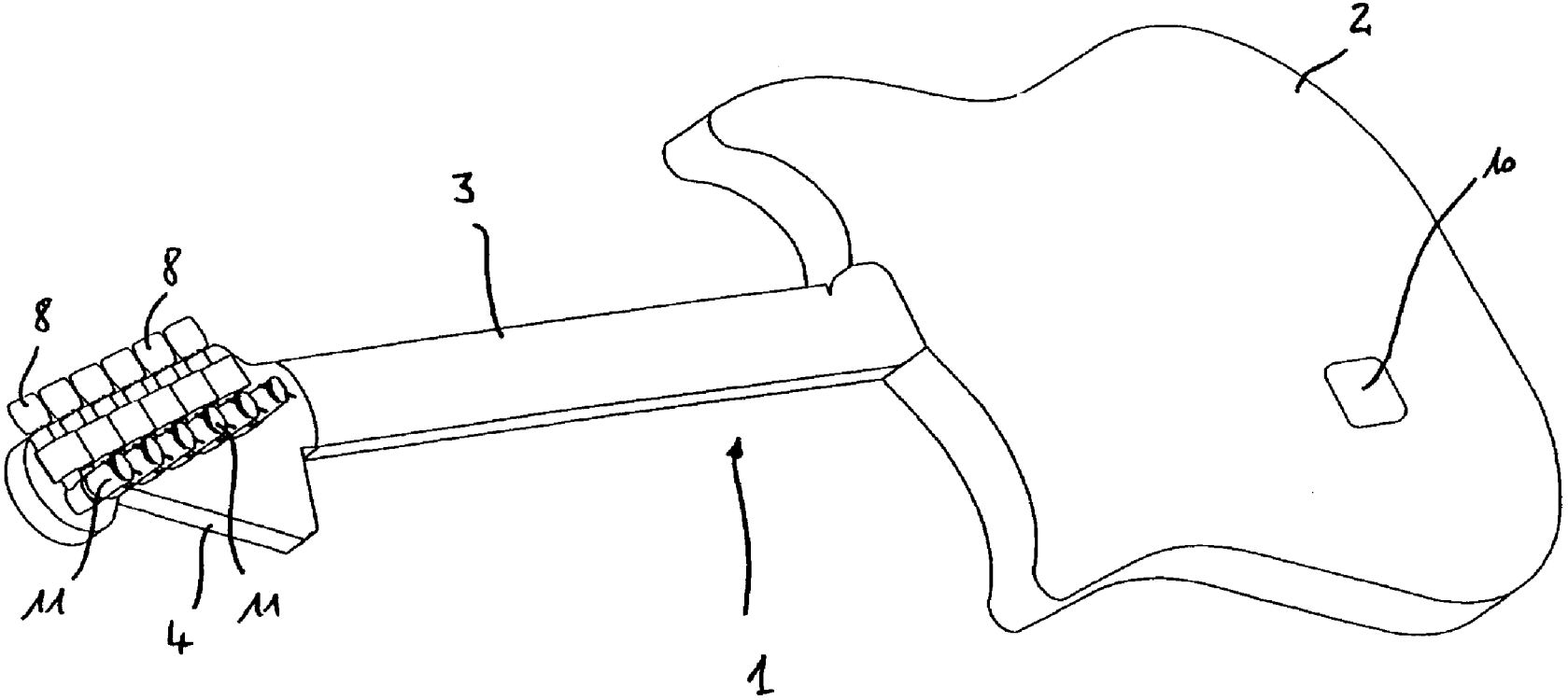

In FIG. 2, it can also be seen that actuators 11 engaging with the mechanism of the tuning pegs 8, for example, by means of gears, are arranged on the head 4 of the electric guitar 1. The actuators belong to the device according to the invention and are connected to the controller chip 10 for control in a way still to be described below. As an alternative to the hand operation by means of the tuning pegs 8, the adjuster devices 7 can be turned with motors and thus the tension of the strings 6*a*-6*f* can be adjusted.

Figure 3:
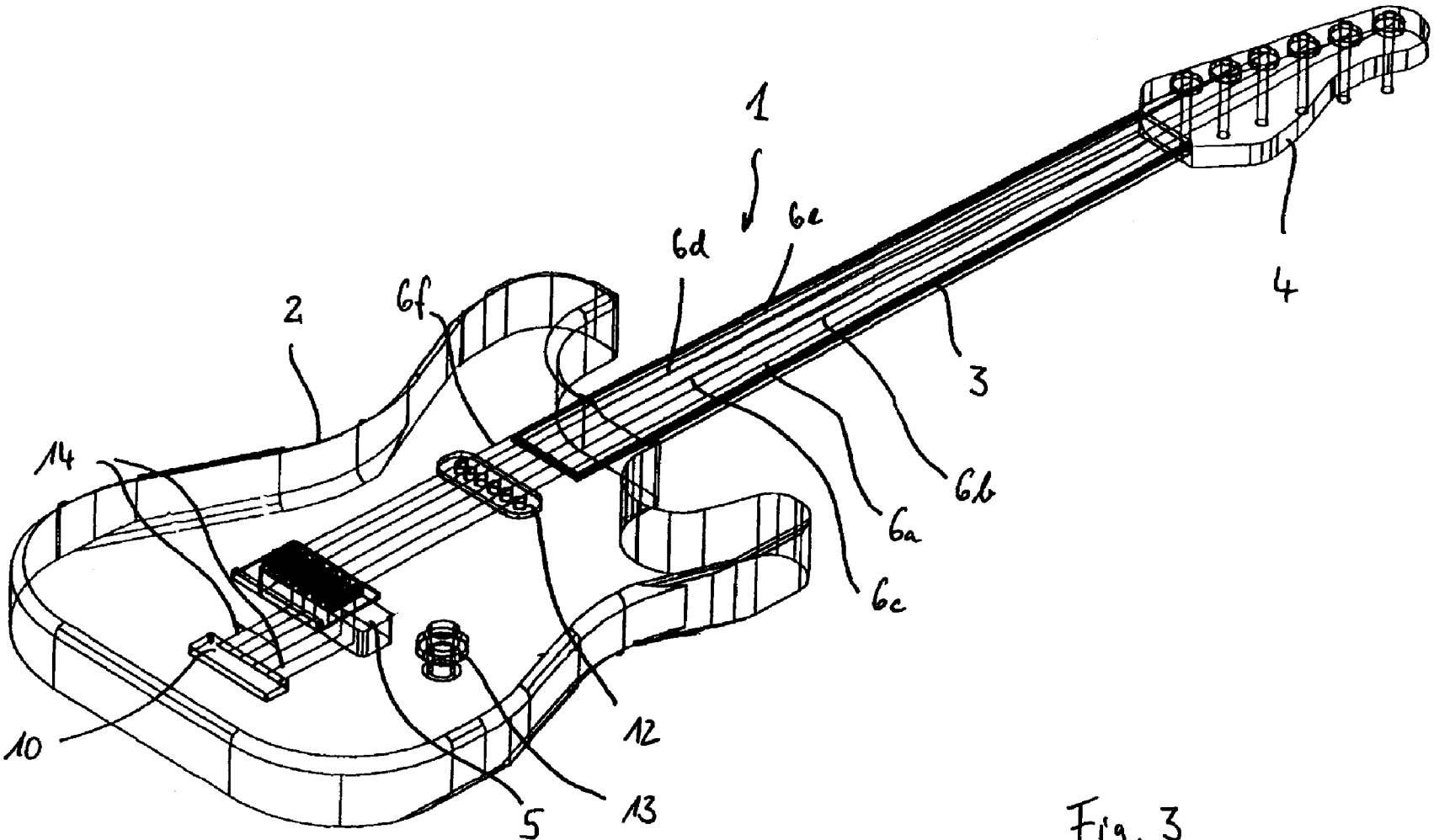
Figure 4:
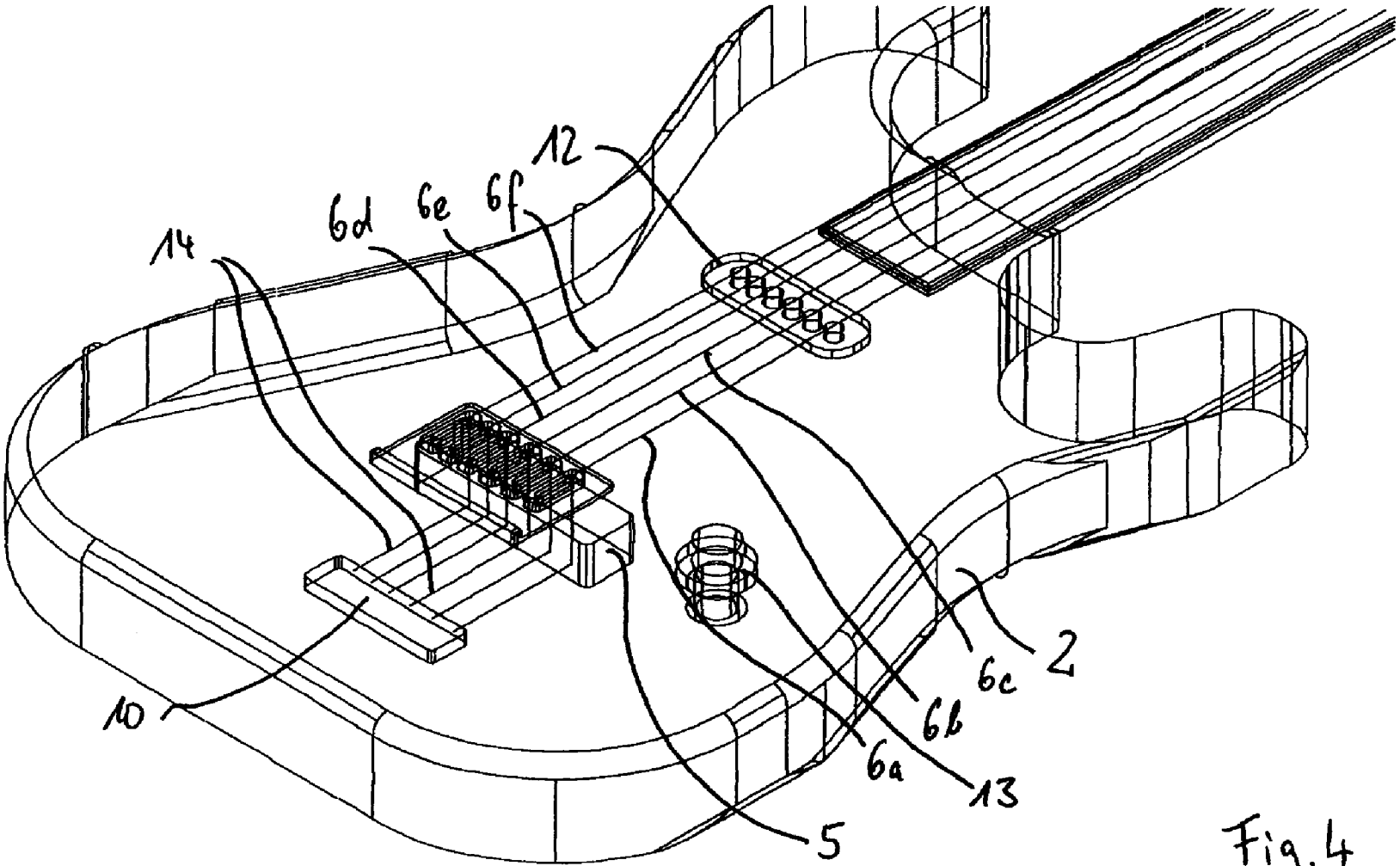

In FIGS. 3 and 4, the electric guitar 1 is shown in a different representation. Here, in addition to the elements to be seen in FIGS. 1 and 2, other details of the electric guitar 1 are shown. For example, the pickups 12 sitting on the body 2 underneath the strings 6*a*-6*f* can be seen, which convert the vibrations of the strings (and thus the tone generated by striking these strings) into an electric signal. These pickups 12 are simultaneously used in a way still to be described below as a component of the device according to the invention.

Furthermore, in these representations, a potentiometer 13 is shown. Usually, electric guitars provide several such potentiometers for setting the treble, bass, and volume levels. Here, the shown potentiometer 13 is the volume regulator. This special regulator is not constructed as a conventional potentiometer for integration of the device according to the invention in the electric guitar 1, but instead as a so-called push-pull potentiometer, which has an additional switching function.

Finally, still to be seen in these figures are the lines 14 leading from the controller chip to the tremolo system block 5, more precisely to the strings 6*a*-6*f*.

Figure 5:
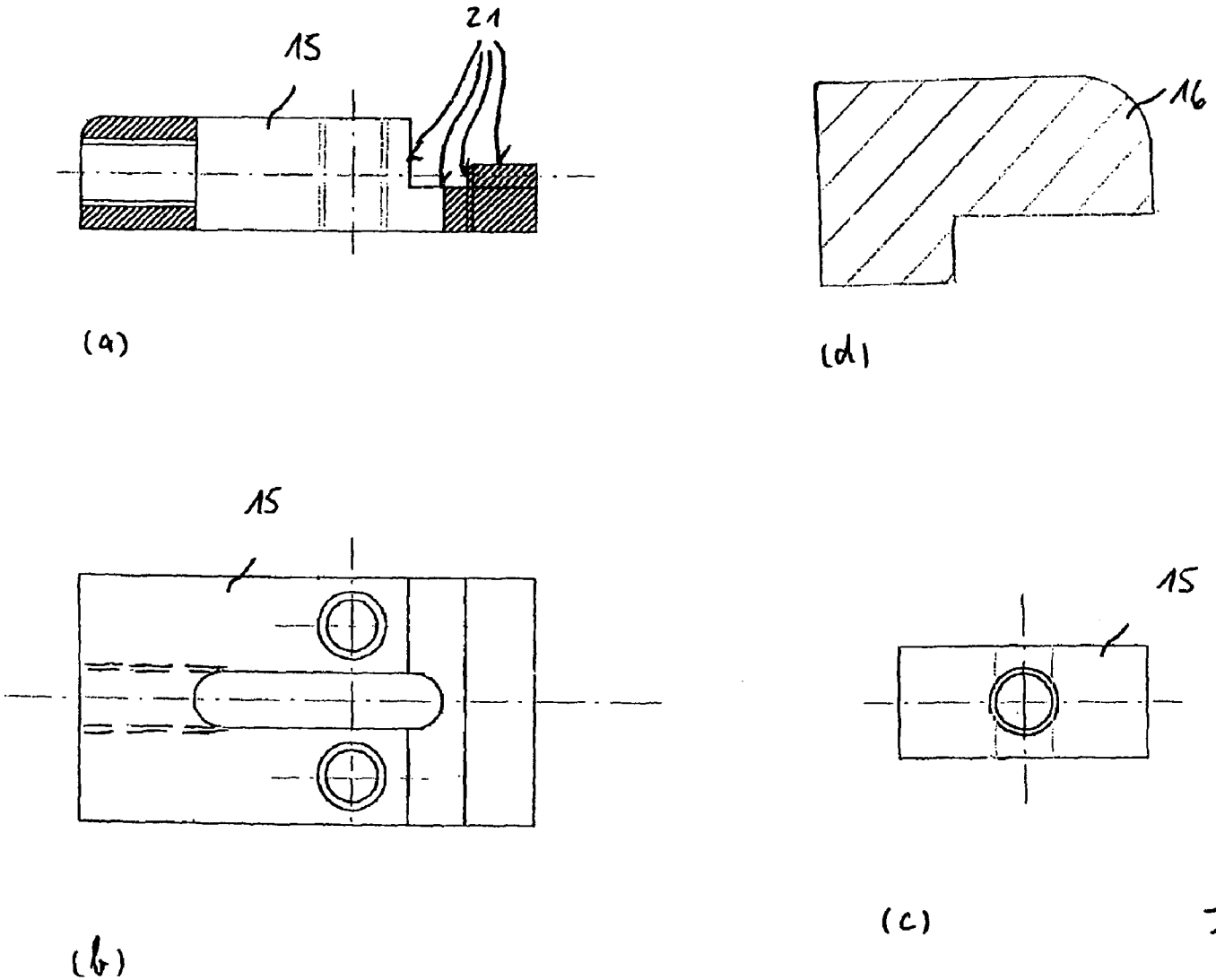
Figure 6:
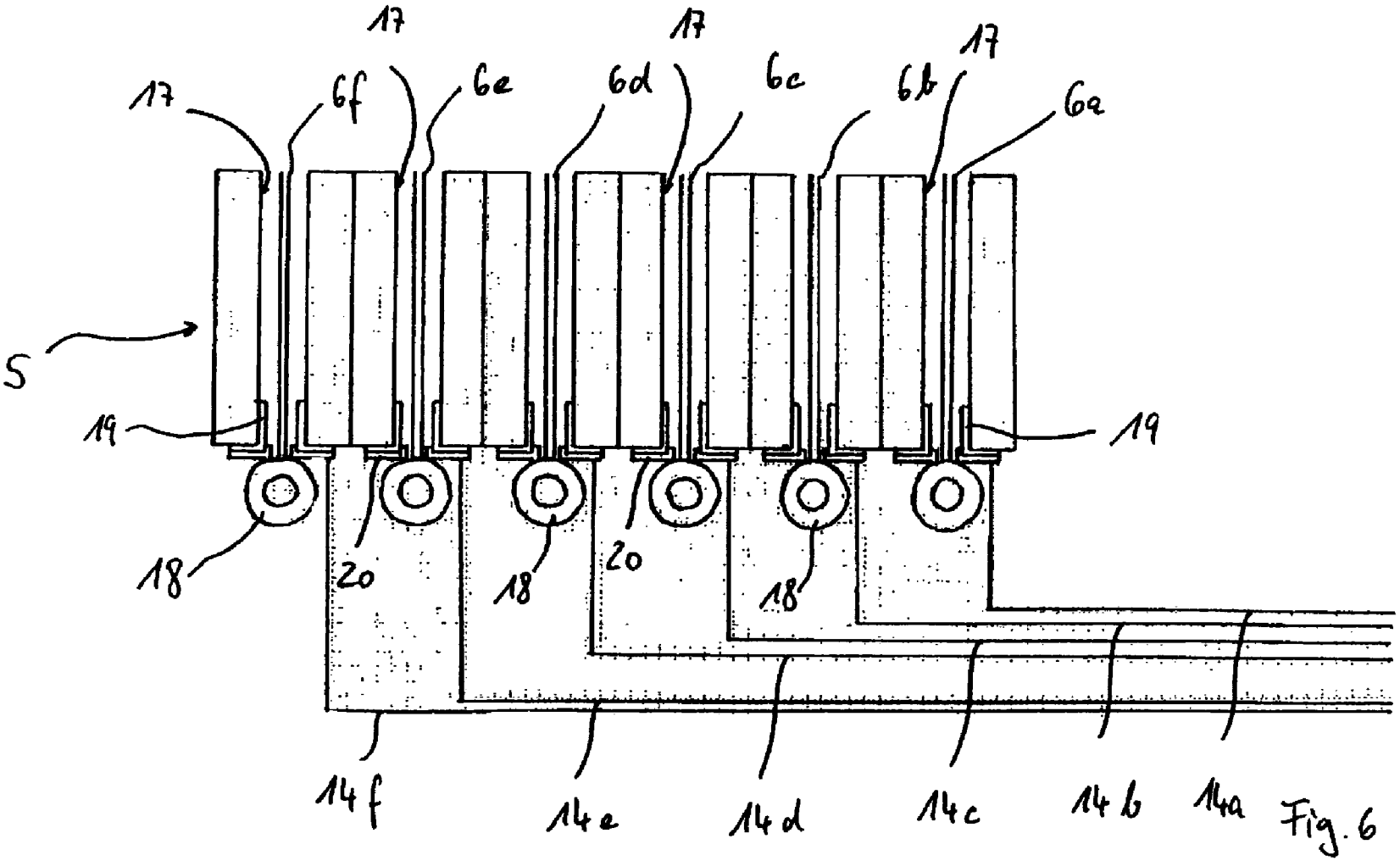

In FIGS. 5 and 6, the tremolo system block 5 and a saddle 15 arranged on this block for guiding the string ends fixed in the tremolo system block 5 are shown, respectively. In FIG. 6 it can be seen how the strings 6*a*-6*f* are guided through bores 17 in the tremolo system block 15 and are held at the bottom edge of the bores 17 with thick sections (ball ends) 18 at their ends. An insulating sleeve 19, which is provided on its edge projecting out of the bore 17 with an outwards pointing flange, is inserted into the bottom end of the bores 17. Conductive disks 20, which contact the thick sections (ball ends) 18 of the strings 6*a*-6*f*, are positioned between the flanges of the sleeves 19 and the thick sections (ball ends) 18. These disks are connected, in turn, with the lines 14 (shown here as 14*a*-14*f*) connected to the controller chip 10.

In this way, the strings 6*a*-6*f* of the electric guitar 1, which are made from a conductive metal or are wound with a conductive metal thread, are connected electrically to the controller chip 10.

The saddles 15 shown in FIGS. 5(*a*)-5(*d*) are mounted on the tremolo system block 5. The strings run over these saddles in the region of the saddle inserts designated with 16. The saddle insert shown enlarged in FIG. 5(*d*) is inserted into the saddle shown in FIG. 5(*a*) [by insertion] into the recess shown on the right in FIG. 5(*a*). Because the saddle 15 and the saddle inserts 16 in an electric guitar 1 are normally composed of metal and thus of a conductive material, the saddle inserts 16, over which the strings 6*a*-6*f* run, must be insulated from each other, in order to prevent a short circuit between the strings, which are electrically contacted via the lines 14. For this purpose, the surfaces designated with 21 in FIG. 5(*a*) are insulated.

Figure 7:
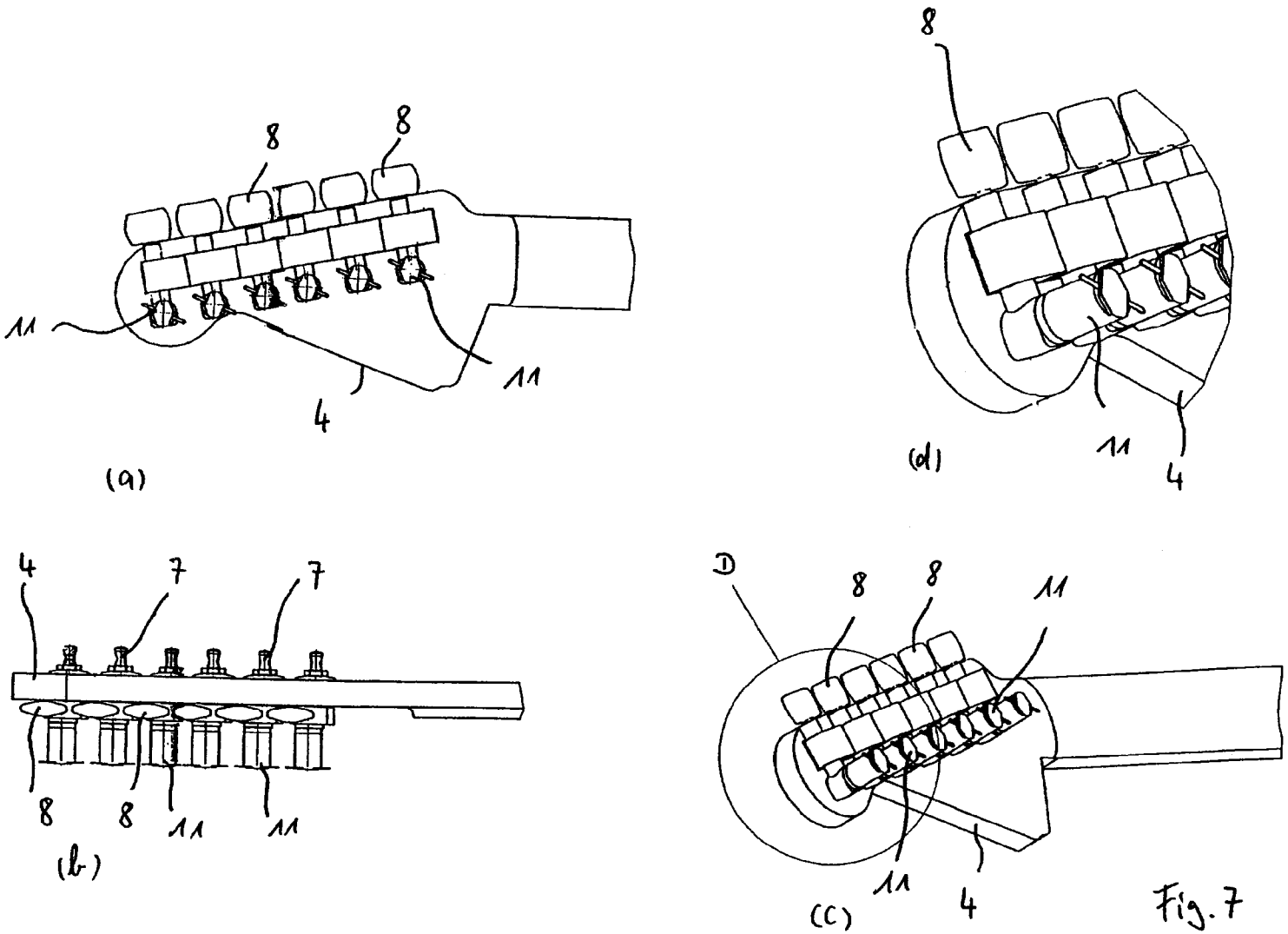

In FIGS. 7(*a*)-7(*d*), details of the head 4 of the electric guitar 1 can be seen again with the attached components of the device according to the invention, with FIG. 7(*d*) representing a detail enlargement of the region designated with D in FIG. 7(*c*).

Figure 8:
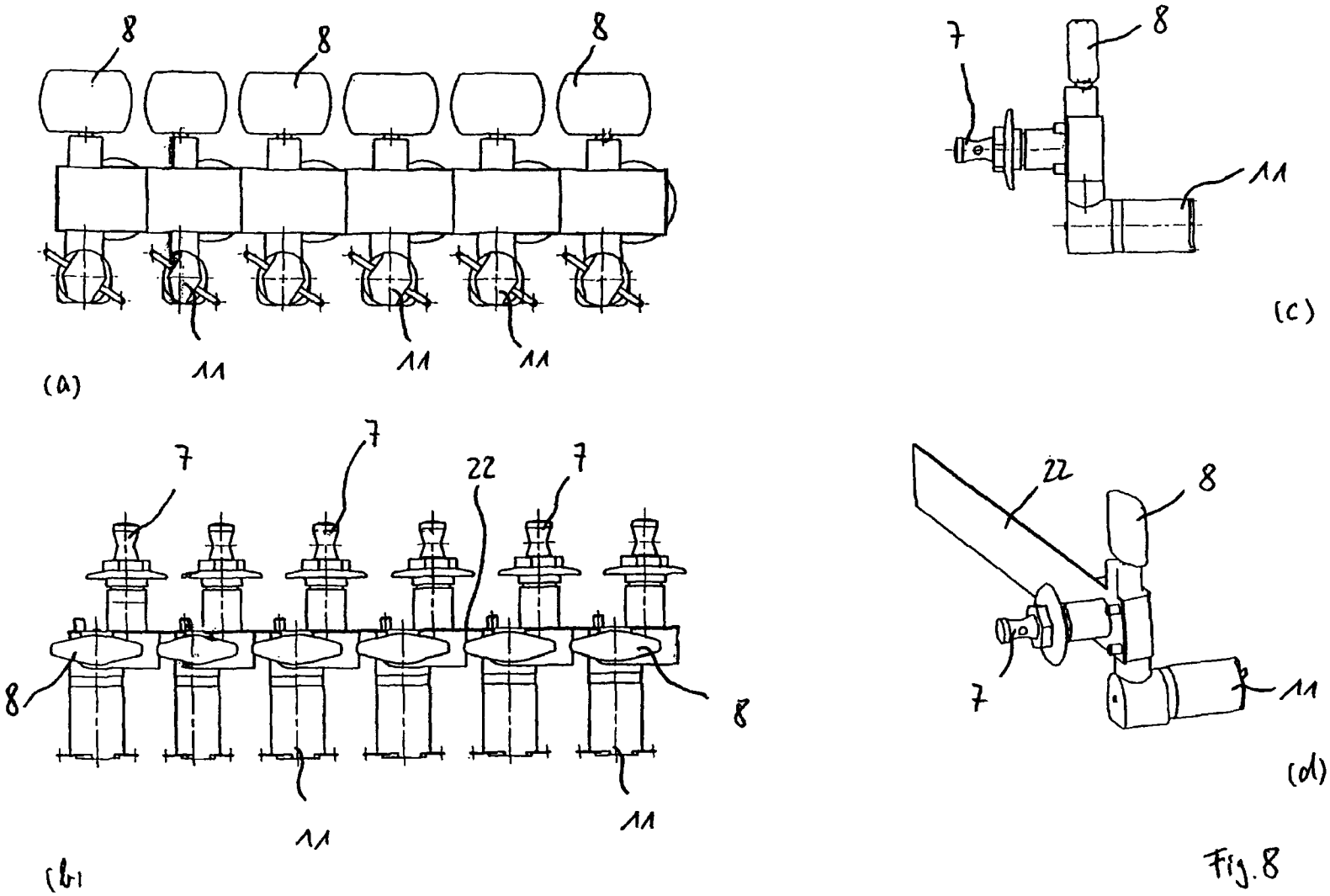

In FIGS. 8(*a*)-8(*d*), the mechanical units for adjusting the string tension are shown, comprising the adjuster devices 7, the tuning pegs 8, and the actuators 11 disengaged from the head 4. To be seen is that all of these units sit on a common circuit board 22, which contains additional control elements for controlling the actuators 11. The strings are connected electrically to corresponding conductor tracks on the circuit board 22 via the metallic and thus conductive adjuster devices 7.

Figure 9:
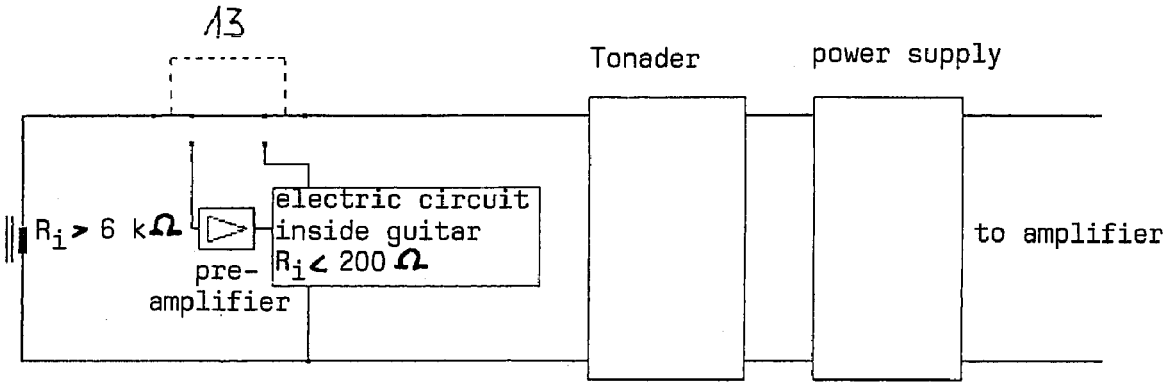

The device according to the invention for automatic tuning of the electric guitar 1 operates as follows:

By pulling the push-pull potentiometer 13, the system is activated. Here, refer to the circuit shown in FIG. 9, which will be described below.

Commands can now be issued to the controller chip 10 by striking one of the strings. The tones generated by striking the strings are converted by the pickups 12 into an electric signal, which is converted to a frequency in the controller. Defined pre-programmed commands, which are called at a frequency lying within a certain tolerance, are stored in the controller. In this way, for example, the program for tuning one of the strings, e.g., the e-string 6*f*, can be called. If the program is activated, then the controller chip loads a reference frequency for this string, which is used as a desired frequency, from a memory. The string is now optionally struck again, the actual frequency is calculated from the signal converted by the pickup 12 in the controller chip 10, and a signal is sent to the circuit board 22 or via this circuit board to the corresponding actuator 11 via the strings used as bus lines for adjusting the string tension for reaching the desired frequency. Here, the controller chip 10 monitors the change in frequency and outputs a stop signal to the actuator 11 when the desired frequency is reached. In this way, all of the strings can be tuned one after the other. A mathematical frequency filter is used as the routine for calculating the actual frequency from the electric signal of the pickups, because this can calculate the frequency especially quickly and reliably.

By means of an interface not shown in the figures, different frequency defaults for the strings can be given to the controller chip 10 according to which type of tuning has currently been selected (for example, open tuning, etc.).

For transmitting the control signals, only two of the strings are needed. By means of two other strings, here the strings 6*f* (low e-string) and 6*e* (a-string), the power supply for the circuit board 22 and the actuators 11 is brought to the head 4, so that a separate power source is not necessary there. The strings 6*f* and 6*e* are selected for transmitting the voltage, because the low e-string and the a-string are the thickest strings of the electric guitar 1 and thus very rarely break. Of the remaining four strings 6*a*-6*d*, any two can be freely controlled by the controller chip 10 as bus lines. In this way, the system is redundant and can still operate if one or even if two of the strings 6*a*-6*d* break.

Light-emitting diodes on the body 2, for example, in the area of the pickups 12 underneath the strings 6*a*-6*f* can display the state of the controller chip 10 or the program sequence and thus simplify the handling of the device. Here, "brief instructions" can also be displayed, e.g., with the display, by striking which of the strings 6*a*-6*f* in which tone which commands are called. The frequencies allocated to the commands can be managed by the controller chip 10, so that they are adapted to the current tuning of the electric guitar, that is, the user must always strike the same string with the same grip in order to call a command, regardless of how the guitar and thus the string has just been tuned.

In this embodiment, the power supply for the system is realized externally, that is, via the amplifier cable, with which the guitar is already connected electrically to an amplifier. The tone wire circuit shown in FIG. 9 constantly monitors the internal resistance of the electric guitar 1. For normal, ready-to-play electric guitars 1, this resistance is high. If the musician now pulls the push-pull potentiometer 13, then this decouples the pickup 12 from the jack socket for the amplifier cable and thus from the amplifier and activates the controller chip 10. In this way, the internal resistance of the electric guitar 1 decreases by a factor of at least 20. This circuit detects this condition and disconnects the amplifier cable, for one, from the amplifier, so that the electric guitar 1 can be tuned in a "muted" state. Furthermore, the circuit switches a power-supply voltage onto the amplifier cable, which can be obtained, for example, from the power-supply part of the amplifier and also from an external power-supply part. This voltage is then fed to the controller 10 and forwarded into the head 4 via the strings 6*e* and 6*f*. Now the device according to the invention can function. After the tuning is complete or, for example, the circuit is installed or new data is entered, the musician switches the push-pull potentiometer 13 back into the normal position. The internal resistance of the electric guitar 1 increases through the pickup 12 now connected again to the amplifier cable. The tone wire circuit detects this according to FIG. 9 and outputs the signals from the amplifier cable back to the amplifier, so that the musician can continue to play.

LIST OF REFERENCE SYMBOLS

1 Electric guitar
2 Body
3 Neck
4 Head
5 Tremolo system block
6*a-f* String
7 Adjuster device
8 Tuning peg
9 Pick guard
10 Controller chip
11 Actuator
12 Pickup
13 Potentiometer
14 Line
15 Saddle
16 Saddle insert
17 Bore
18 Thick section
19 Sleeve
20 Disk
21 Surface
22 Circuit board

The invention claimed is:

1. Device for automatic tuning of a string instrument, in particular, a guitar, comprising:

a) a detection device for detecting a tone generated when a string is struck as well as for the output of a digital signal corresponding to the detected tone, b) a memory device for storing preset digital signals, which correspond to a desired tone, c) a comparison device for comparing the digital signal output by the detection device with a digital signal stored in the memory device and corresponding to the desired tone, d) an adjustment device for changing the tension of the strings, e) at least one drive for driving the adjustment device, f) a controller, which is connected to the comparison device and which controls the one or more drives with reference to a deviation determined in the comparison device between signals representing the generated tone and the desired tone, and g) at least one electrically conductive string selected from a string composed of an electrically conductive material, a string wound with an electrically conductive material and a string coated with an electrical conductive material, wherein the at least one electrically conductive string extends longitudinally between the body and head end of the instrument and includes a first, body end operatively coupled to a power supply source and an opposite, head end operatively coupled to the adjustment device.

2. Device according to claim 1, wherein the controller is arranged on an opposite body end of the strings from the one or more drives arranged at the head end of the strings viewed in the longitudinal direction of the strings and further comprising a bus line between the controller and the one or more drives bridging the length of the strings.

3. Device according to claim 2, wherein the bus line is at least one of the strings selected from a string composed of electrically conductive material, a string wound with an electrically conductive material and a string coated with an electrically material.

4. Device according to claim 1, wherein the controller includes a physical memory chip storing program commands that instruct the controller to be switched to signal an adjustment of string tension in response to receiving from the detection device a digital signal representing a tone lying within a tolerance span.

5. Device according to claim 1, further comprising a tuning type selection interface coupled to the controller.

6. Device according to claim 1, wherein an adjustment device with its own drive is allocated to each string.

7. Device according to claim 1, wherein the detection device, memory device, comparison device, adjustment device, drive, and controller are integrated completely into the string instrument.

8. Device according to claim 2, wherein one or more replacement strings selected from one or more of a string used as bus line and a string used as a power line are operatively and selectably coupled to the controller as a redundancy to one or more other strings including one or more of a bus line and power line during a break or interruption.

9. Device according to claim 1, wherein said device is integrated into a guitar, selected from an acoustic guitar and an electric guitar.

10. Device according to claim 9, wherein the controller is arranged on the body of the guitar and the adjustment device and the one or more drives are arranged at the top end of the neck and the one or more drives are connected to the controller via at least one of a bus line running along the neck and one or more of the strings used as the bus line.

11. Method for automatic tuning of a string instrument, comprising:

1. striking a string to be tuned,
2. detecting a tone generated and converting said tone into a corresponding first digital signal,
3. comparing the first digital signal with a predetermined second digital signal corresponding to a desired tone and calculating a desired change to apply in the string tension from the comparison, and
4. supplying power for adjusting string tension from a first end of the strings in the longitudinal direction to an opposite, second end of the strings via at least one of the strings that is one of a string composed of an electrically conductive material, a string wound with an electrically conductive material and a string coated with an electrically conductive material.

12. Method according to claim 11, further comprising outputting a control signal from the controller arranged on a first end of at least one string used a bus line to a drive connected to an adjustment device for setting the string tension and wherein the adjustment device is coupled to the opposite end of the at least one string used as a bus line viewed in the longitudinal direction.

13. Method according to claim 12, further comprising using as a bus line one or more strings of the string instrument which are at least one of made from a conductive material, wound with a conductive material and coated with a conductive material.

14. Method according to claim 12, further comprising determining a frequency from the first digital signal.

15. Method according to claim 14, wherein the frequency is determined from the first digital signal by means of a mathematical frequency filter and the second digital signal corresponds to a predetermined frequency.

* * * * *